US007681660B2

(12) United States Patent
Muona

(10) Patent No.: US 7,681,660 B2
(45) Date of Patent: Mar. 23, 2010

(54) ARRANGEMENT FOR POSITIONING DRILLING UNIT

(75) Inventor: Jouko Muona, Siuro (FI)

(73) Assignee: Sandvik Mining and Construction Oy, Tampere (FI)

( * ) Notice: Subject to any disclaimer, the term of this patent is extended or adjusted under 35 U.S.C. 154(b) by 49 days.

(21) Appl. No.: 11/922,895

(22) PCT Filed: Jun. 22, 2006

(86) PCT No.: PCT/FI2006/050275

§ 371 (c)(1),
(2), (4) Date: Dec. 26, 2007

(87) PCT Pub. No.: WO2007/000488

PCT Pub. Date: Jan. 4, 2007

(65) Prior Publication Data

US 2009/0078438 A1 Mar. 26, 2009

(30) Foreign Application Priority Data

Jun. 27, 2005 (FI) ..... 20055351

(51) Int. Cl.
*E21B 15/04* (2006.01)

(52) U.S. Cl. ..... 173/4; 173/1; 173/11; 173/18; 173/20; 173/184

(58) Field of Classification Search ..... 173/1, 173/4, 11, 18, 20, 91, 184; 175/19, 296; 405/259.1, 232
See application file for complete search history.

(56) References Cited

U.S. PATENT DOCUMENTS 4,343,367 A 8/1982 Mashimo
4,542,794 A * 9/1985 Bjor ..... 173/1
4,601,000 A * 7/1986 Montabert ..... 173/11
4,698,570 A 10/1987 Satoh
5,129,466 A * 7/1992 Bartels et al. ..... 173/13
5,383,524 A * 1/1995 Rinnemaa ..... 173/1
5,396,964 A * 3/1995 Shellhorn et al. ..... 175/195
5,699,261 A * 12/1997 Muona ..... 700/160
5,772,362 A * 6/1998 Sims ..... 405/232

(Continued)

FOREIGN PATENT DOCUMENTS

DE 39 02 127 7/1990

(Continued)

OTHER PUBLICATIONS

An English translation of a Russian Office Action (undated) issued in Russian Application No. 2008103010.

(Continued)

*Primary Examiner*—Brian D Nash
(74) *Attorney, Agent, or Firm*—Drinker Biddle & Reath LLP

(57) ABSTRACT

A method and a software product for positioning a drilling unit in a rock drilling rig, and a rock drilling rig. The drilling unit (5) included in the rock drilling rig (1) is manually displaced towards a starting point (14) of a hole (19) to be drilled next. A control unit (11) in the rock drilling rig (1) performs after the manual displacement (A) an automatic positioning (B) accurately to the starting point in order to initiate drilling.

16 Claims, 3 Drawing Sheets

U.S. PATENT DOCUMENTS

| | | | | |
|---|---|---|---|---|
| 5,853,052 | A * | 12/1998 | Baiden et al. | 173/15 |
| 5,954,143 | A * | 9/1999 | McCabe et al. | 173/184 |
| 6,814,160 | B1 * | 11/2004 | Scott | 175/19 |
| 6,957,707 | B2 * | 10/2005 | Koivunen et al. | 175/27 |
| 7,165,630 | B2 * | 1/2007 | Arnston et al. | 173/1 |
| 7,231,989 | B2 * | 6/2007 | Salminen et al. | 173/1 |
| 7,424,920 | B2 * | 9/2008 | Bergstrand et al. | 175/24 |
| 2004/0140112 | A1 * | 7/2004 | Salminen et al. | 173/1 |
| 2005/0100415 | A1 * | 5/2005 | Larovere | 405/232 |

FOREIGN PATENT DOCUMENTS

| | | |
|---|---|---|
| JP | 10-96627 | 4/1998 |
| WO | 03/048524 | 6/2003 |

OTHER PUBLICATIONS

Feldman et al., "Automated Shaft Drilling Rigs-Boring Robots", Moscow, Nedra, 1989, pp. 71-73, 85, 132-133, and 136-143.

* cited by examiner

ARRANGEMENT FOR POSITIONING DRILLING UNIT

BACKGROUND OF THE INVENTION

The invention relates to a method and a software product for positioning a drilling unit in a rock drilling rig at the starting point of a hole to be drilled in order to initiate drilling. The invention also relates to a rock drilling rig, in which the drilling unit is positioned by moving a drilling boom to the starting point of the hole.

The object of the invention is more specifically defined in the preambles of the independent claims.

Rock is generally excavated according to a predetermined plan. In order to cut the rock as desired when using explosives, drill holes are drilled for each break in accordance with a previously drawn up drilling plan. When the positioning of the drilling unit is performed manually the operator controls the drilling unit accurately to the location of the hole to be drilled shown in the drilling plan and aligns the drilling unit in accordance with the drilling plan. However, positioning the drilling unit accurately at the starting point is slow and difficult.

BRIEF DESCRIPTION OF THE INVENTION

It is an object of the present invention to provide a new and improved method and a software product for positioning the drilling unit at a hole to be drilled next. Another object of the invention is to provide a new and improved rock drilling rig provided with a system for positioning the rock drilling unit at the drill hole to be drilled next.

The method according to the invention is characterized by performing a manual displacement of the drilling unit towards a next hole to be drilled, and performing after the manual displacement an automatic positioning, where the drilling unit is moved under the control of a control unit to the location of a starting point of the drill hole in order to initiate drilling.

The software product according to the invention is characterized in that performing the software product in the drilling unit is arranged to determine the location of the drilling unit in the control unit in relation to at least some of the starting points of the holes according to the drilling plan, to allow the manual displacement of the drilling unit performed by the operator towards the drill hole to be drilled next, and to perform after the manual displacement the automatic positioning to the starting point of the hole to be drilled next in order to initiate drilling.

The rock drilling rig according to the invention is characterized in that the control unit is arranged to determine the location of the drilling unit in relation to at least some of the starting points of the holes according to the drilling plan, that the drilling unit is arranged to be displaced at first manually towards the next drill hole to be drilled and that the control unit is arranged to perform after the manual displacement an automatic positioning to the starting point of the next hole in order to initiate drilling.

It is an idea of the invention that an operator performs the manual displacement of the drilling unit towards a drill hole to be drilled in accordance with the drilling plan. During manual displacement the operator manually directs the drilling unit towards the next hole. During the last stage of positioning the drilling unit is automatically positioned under the control of the control unit to the location of the starting point of the selected drill hole. After positioning the drilling unit is placed such that drilling according to the drilling plan can be initiated.

An advantage of the invention is that the accurate positioning of the drilling unit, which is slow and difficult, is transferred to be carried out by the control unit, in which case the operator may during what is known as fine positioning for instance prepare for drilling the next drill holes or monitor the operation of other possible drilling units and devices include in the rock drilling rig. The final accuracy of the positioning is still independent of the skill of the operator. The invention allows the operator to independently select the hole to be drilled next among the holes according to the drilling plan and may utilize the automatic positioning function for the hole during positioning in order to facilitate his work.

An idea of an embodiment of the invention is that the control unit identifies the drill hole to be drilled next on the basis of the manual displacement.

An idea of another embodiment of the invention is that the drilling unit is manually displaced towards the starting point of the drill hole according to the drilling plan. At the same time the control unit monitors the manual displacement and detects if the manual displacement takes place towards a starting point of a drill hole according to the drilling plan. The control unit is then capable of interpreting that the hole towards which the drilling unit is displaced is to be the next hole to be drilled. The control unit may suggest in one way or another an automatic positioning for the hole.

An idea of an embodiment of the invention is that at the same time as the drilling unit is displaced manually towards the starting point of the drill hole according to the drilling plan, distances are measured for at least some of the holes according to the drilling plan. The control unit may be arranged to perform the automatic positioning at the starting point of the drill hole that is closest to the drilling unit after the manual displacement. Then the operator may by means of a simple and fast manual displacement move the drilling unit close to the starting point of the next hole and thereafter assign the accurate positioning that is slow and difficult to be carried out by the control unit.

An idea of a further embodiment of the invention is that the control unit is arranged to provide the operator with the indication of the detected starting point of the hole to be drilled on the basis of the manual displacement, for instance by means of a display unit in the control unit. When the operator has ended the manual displacement, he may activate the automatic positioning for the hole indicated by the control unit, or the operator may interrupt the manual displacement and authorize the start of the automatic positioning to the hole indicated by the control unit. Furthermore, the control unit may be arranged to automatically start the automatic positioning towards the hole indicated.

An idea of another embodiment of the invention is that the drilling unit is at first displaced manually close to, or sufficiently close to, the starting point of the drill hole according to the drilling plan. After the drilling unit is placed closer to the starting point of the hole than the predetermined distance, the automatic positioning is switched on. In automatic positioning the control unit fine positions the drilling unit accurately to the starting point of the hole, and thereafter drilling may be initiated. The distance limit may be set beforehand in the control unit, or it may be set case-specifically. The length of the distance limit may be 0.5 meters or another appropriate distance. If the drilling unit is located further from the predetermined distance limit from the selected drill hole, the control unit may request the operator to confirm the start of the automatic positioning, or alternatively the control unit may request the operator to manually displace the drilling unit closer to the selected drill hole before the automatic positioning can be initiated. In this way it is possible to ensure if necessary that the slow final positioning is not carried out until the drilling unit is sufficiently close to the next drill hole. The manual displacement close enough to the next drill hole can be carried out rapidly.

An idea of a further embodiment of the invention is that the display unit in the control unit shows the starting points of the holes to be drilled and the location of the drilling unit. The control element placed in the control unit allows moving manually the drilling unit for the positioning thereof. The location of the drilling unit is indicated by the cursor on the display unit. The cursor may also be provided with a locking area of predetermined magnitude in the display unit. When the starting point of the hole to be drilled is within the locking area restricted by the cursor, the control unit may detect the drilling unit to be sufficiently close to the starting point and may accept the start of the automatic positioning.

An idea of a further embodiment of the invention is that the control function according to the invention is arranged to form a part of the automatic rock drilling rig. Thus the operator may if desired switch on the control function of the invention, whereby the drilling may be carried out regarding the desired drill holes in a manner deviating from the automatic drilling sequence of the rock drilling unit. Furthermore, the displacement to the vicinity of the next hole to be drilled can be accelerated by performing the rough displacements manually instead of the automatic positioning.

An idea of still a further embodiment of the invention is that new holes are generated or added to the drilling plan after the drilling of the drill holes according to the drilling plan has already been initiated.

BRIEF DESCRIPTION OF THE DRAWINGS

In the following the embodiments of the invention are described in greater detail in the accompanying drawings, in which FIG. 1 schematically shows a rock drilling rig according to the invention, FIG. 2 schematically shows an arrangement according to the invention for positioning a drilling unit, FIG. 3 schematically shows a drilling plan and the positioning of the drilling unit at a hole to be drilled next, FIG. 4 schematically shows the drilling plan and another arrangement for positioning the drilling unit at the hole to be drilled next, FIG. 5 schematically shows a user interface of a control unit in the rock drilling rig and further illustrates a method according to the invention for positioning the drilling unit, and FIG. 6 schematically shows a display unit and illustrates an application for positioning the drilling unit.

For clarity, the invention is shown in simplified form in the Figures. Similar parts are indicted with the same reference numerals in the Figures.

DETAILED DESCRIPTION OF THE EMBODIMENTS OF THE INVENTION

Figure 1:
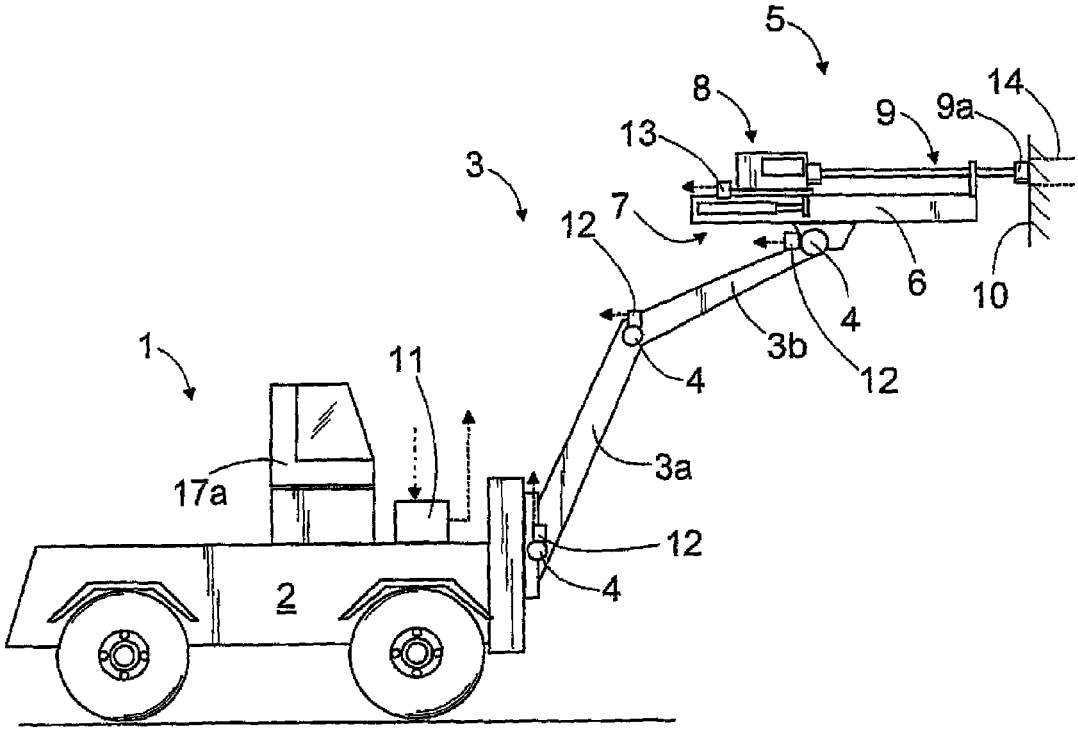
Figure 3:
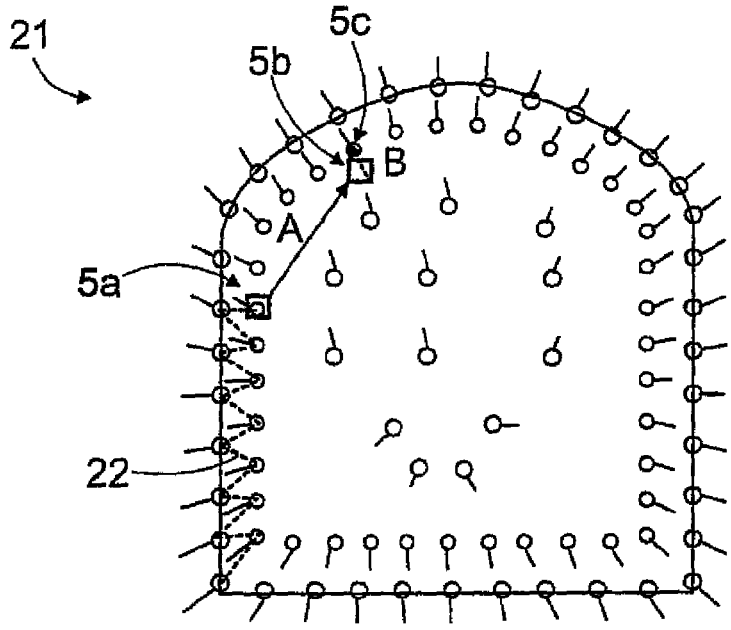
Figure 4:
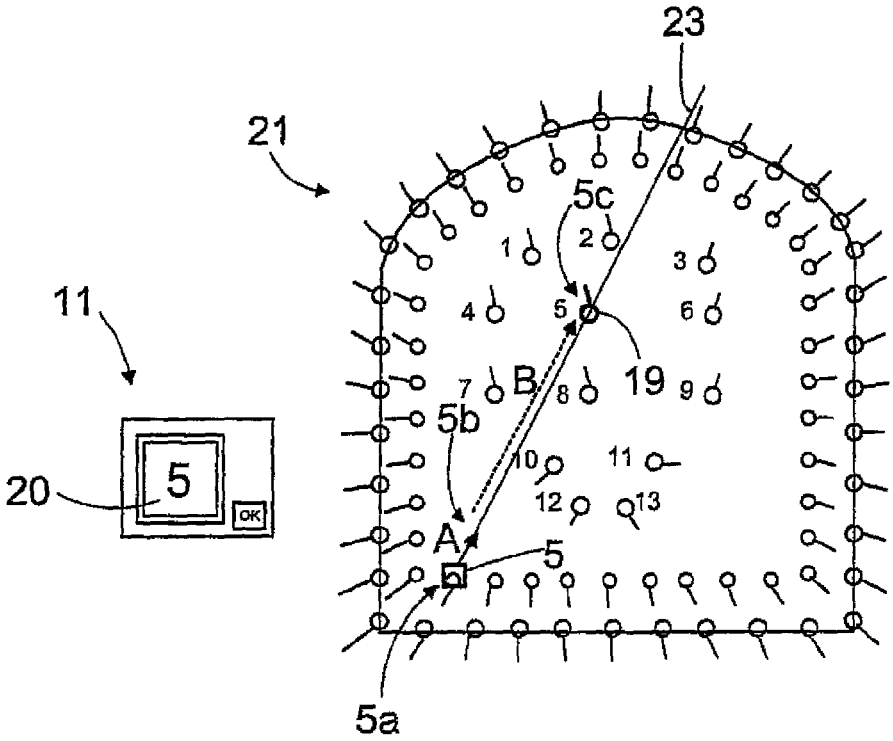

A rock drilling rig 1 shown in FIG. 1 may comprise a movable carrier 2 provided with one or more drilling booms 3. The drilling boom 3 may include one or more boom parts 3*a*, 3*b*, which may be coupled to one another and to the base 2 with joints 4 such that the booms 3 can be moved in many ways in different directions. In addition, the free end of the drilling boom 3 is provided with a drilling unit 5, which may comprise a feeding beam 6, a feeding device 7, a rock drilling machine 8 and a tool 9 provided at the outermost end thereof with a drill bit 9*a*. The rock drilling machine 8 can be moved by means of the feeding device 7 in relation to the feeding beam 6 such that the tool 9 can be fed during drilling towards the rock 10. The rock drilling machine 8 may comprise a percussion device that may be used to provide shock pulses to the tool 9, and also a rotating device for rotating the tool 9 about the longitudinal axis thereof. Furthermore, the rock drilling rig 1 may comprise one or more control units 11 for controlling drilling. The control unit 11 may comprise one or more processors, a programmable logic or a corresponding device, in which a software product can be performed, the performance of which allows accomplishing the method of the invention for positioning the drilling unit. In addition, the control unit 11 may be provided with a drilling plan, in which the location and direction of the holes to be drilled are defined. Below, FIGS. 3 and 4 show a couple of possible drilling plans. Also, the control unit 11 may be provided with a drilling sequence, where at least a drilling order is also defined. The control unit 11 may provide commands for actuators moving the drilling boom 3, for the feeding device 7 and for other actuators affecting the position of the drilling unit 5. Also, at the joints 4 of the drilling boom 3 one or more sensors 12 may be provided, and one or more sensors 13 may be provided at the drilling unit 5. The measuring information obtained from the sensors 12, 13 can be directed to the control unit 11, which on the basis of the measuring information may determine the location and direction of the drilling unit 5 for the control. The control unit 11 may be arranged to process the position of the drilling unit 5 as the location of the drill bit 9*a* and as the direction of the longitudinal axis of the tool 9.

Figure 2:
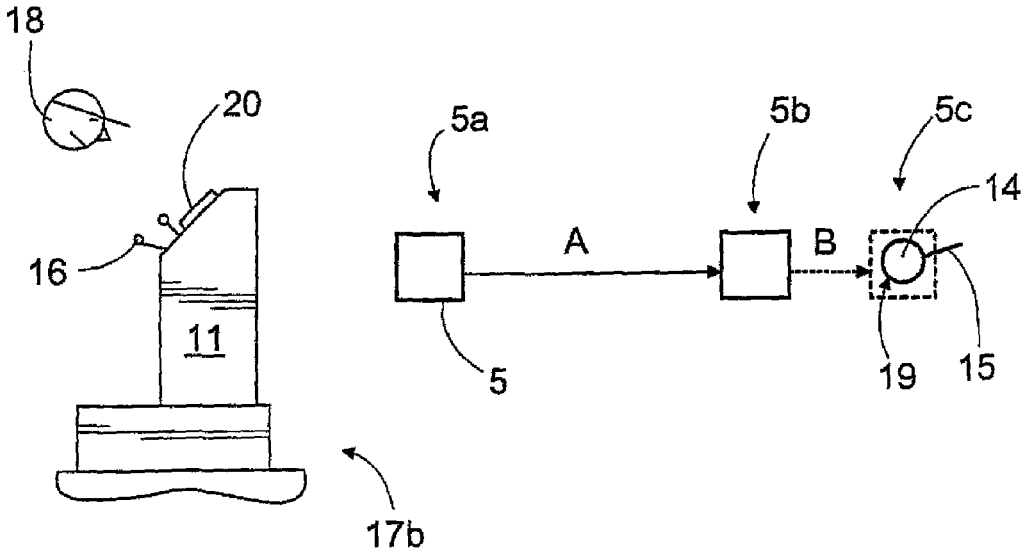

FIG. 2 illustrates a method according to the invention for positioning the drilling unit 5 in relation to a hole 14 to be drilled. For positioning the drilling unit 5 a starting point 14 of the hole to be drilled may be determined in advance in the control unit 11 as well as a direction 15 of the drilling. In FIGS. 2 to 6 the drilling unit 5 is shown in simplified form with square symbols. The drilling unit 5 is provided with a starting position 5*a* before starting the positioning according to the invention, from which position the drilling unit can be displaced towards the starting point 14 of the drill hole to be drilled next and selected by the operator using manual control devices 16, which may be placed in a control cabin 17*a*, at a drilling level 17*b* or somewhere else in the vicinity of the control unit 11. In the most simple form the operator 18 controls by means of the control devices 16 the cylinders moving the drilling boom 3 and possible other actuators such that the manual control allows displacing the drilling unit 5 towards the starting point 14 of a hole 19 to be drilled selected by the operator. The operator 18 may perform the displacement of the drilling unit 5 under direct visual control, but on the other hand the operator 18 may follow the progress of the displacement from a display unit 20 of the control unit 11, if the visibility to the place to be drilled is poor. The operator 18 may displace the drilling unit 5 rapidly and without the complicated automatic control to an imaginary intermediate position 5*b* illustrated in FIG. 2, where the manual displacement A can be changed to an automatic positioning B. The most accurate and time-consuming fine positioning to the starting point 14 of the hole 19 to be accurately drilled can therefore be carried out automatically under the control of the control unit 11. The intermediate position 5*b* may be an imaginary position, for which no location is defined. Therefore the intermediate position 5*b* may describe for instance the time instant, when the operator 18 ends the manual displacement A and authorizes the control unit 11 to start the automatic positioning B for the selected hole 19. A condition for transferring from the manual displacement A to the automatic positioning B is naturally the fact that the control unit 11 has to know which hole is to be drilled next. The hole 19 selected by the operator 18 can be detected and somehow indicated to the control unit 11 during the manual displacement A, in which case the control unit 11 is after the manual displacement A capable of performing the automatic positioning in the starting point 14 of the selected drill hole 19. However, the operator 18 may decide when he hands over the positioning to be carried out by the control unit 11. Thus, the operator 18 is able to continue the manual displacement A and to move the drilling unit 5 fairly close to the starting point 14, whereby the rough positioning is performed rapidly.

FIG. 3 shows a drilling plan 21 and illustrates the positioning of the drilling unit 5. The drilling unit 5 may be arranged to drill drill holes according to the drilling plan 21 in a predetermined order. Such a drilling sequence 22 is indicated in FIG. 3 with a dashed line. In some cases the operator 18 may, however, wish to deviate from the predetermined drilling order and select another hole instead of the drill hole defined in the sequence 22 as the hole 19 to be drilled next. Consequently the operator 18 may interrupt the drilling sequence 22, switch the apparatus into manual positioning and perform the manual displacement A of the drilling unit 5 towards the next drill hole 19 selected by the operator himself.

The control unit 11 may be arranged to determine the location of the drilling unit 5 and the distances to the drill holes according to the drilling plan. The control unit 11 may also be provided with a control function, which is arranged to perform the automatic positioning B of the drilling unit 5 to the starting point 14 of the drill hole that is placed at the shortest distance from the drilling unit 5. The operator 18 moves the drilling unit 5 close to the hole 19 desired to be drilled using the manual displacement A, in which case the hole in question is closest to the drilling unit 5 and the control unit 11 may perform the automatic positioning B to the starting point 14 thereof. The control unit 11 may comprise different auxiliary devices and systems indicating which hole according to the drilling plan 21 is placed closest to the drilling unit 5. The closest hole can be indicated for instance with a deviating colour, a flashing symbol of the hole, a cursor or by showing the hole with a symbol that is brighter than the others on the display of the control unit 11. After this, when the drilling unit 5 is positioned using the automatic positioning B at the starting point of the hole 19, the hole is drilled, and thereafter drilling is continued in the order according to the original drilling sequence 22 or alternatively the operator 18 may select a new hole 19 to be drilled and start the manual displacement A towards said hole.

FIG. 4 shows another drilling plan 21 and illustrates the positioning of the drilling unit 5 associated therewith. The drilling unit 5 has drilled a drill hole at the starting position 5*a*, and thereafter the operator 18 may select a new hole 19 to be drilled. The holes may be indicated in the drilling plan 21 with an identifier, such as the numbering shown in FIG. 4. In this case the operator 18 then selects hole number five as the next hole 19. The operator 18 may start the manual displacement A towards the hole. The control unit 11 may be arranged to monitor the direction of the positioning to be carried out and to detect if the direction of the displacement points towards a hole according to the drilling plan. The control unit 11 may indicate in an appropriate way that it has observed that the positioning takes place towards this hole and that the automatic positioning to the starting point of the hole can be selected. In FIG. 4 the direction of the manual displacement A is illustrated with a guideline 23 that moves through hole number five. What is considered to be a hole according to the drilling plan 21 on the line 23 of the manual displacement A can be indicated for instance on the display unit 20 of the control unit 11 by means of the number of the drill hole. The control unit 11 may be arranged to wait for the operator 18 to accept the automatic positioning B, when it has observed that a hole is on the line 23 of the manual displacement A. When the operator 18 has accepted the hole proposed by the control unit 11, the automatic positioning B is initiated. If the drilling plan 21 is shown entirely or partly on the display unit 20, then the hole placed on the line 23 of the manual displacement A can be indicated with an appropriate visual special effect, such as a flashing symbol.

It is also possible that the operator 18 feeds the identifier of the hole 19 to be drilled next, for instance a hole number, a code or the like, to the control unit 11 before starting the manual displacement A, during the displacement or after the displacement. The operator 18 may indicate the next hole to be drilled also on the display of the control unit 11.

Figure 5:
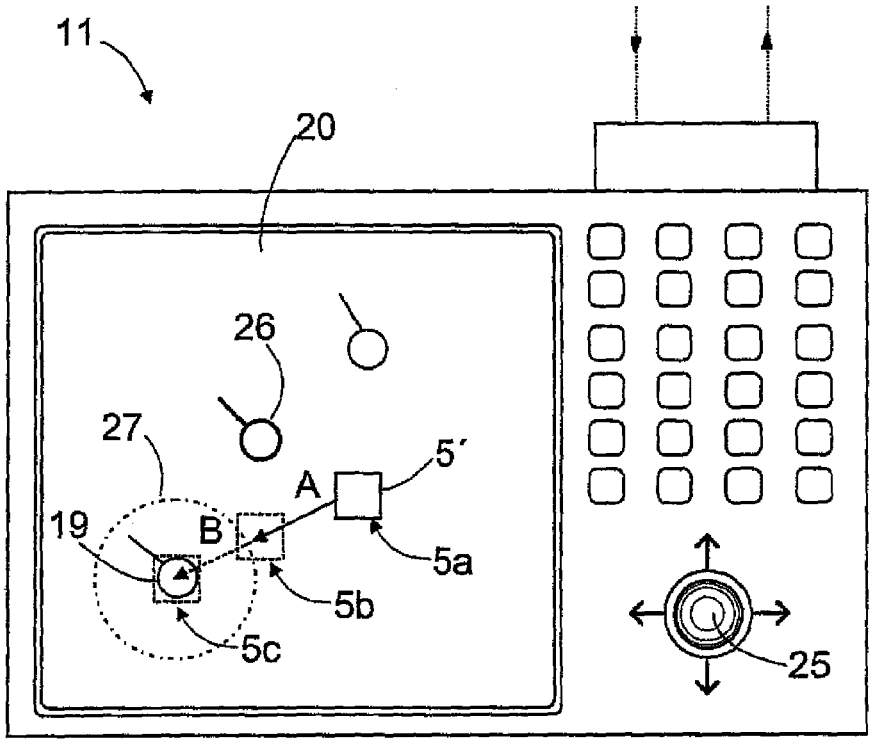

FIG. 5 shows a solution for performing the manual displacement A in the control unit 11 as an alternative to a displacement performed using the manual control devices 16. The drilling plan 21 or a particular part thereof can be shown on the display unit 20 of the control unit 11. On the display unit 20 the position of the drilling unit 5 can be shown with a symbol 5', in this case a square. The actual position of the drilling unit 5 can be determined by means of sensors 4 and the position of the symbol 5' can be connected to the drilling plan 21 shown on the display unit 20. The drilling unit 5 may be arranged to move simultaneously when the symbol 5' is moved on the display unit 20 for instance with arrow keys, a joystick, a touch screen or another controller 25. In FIG. 5 the drilling unit 5 is placed at the starting position 5*a*, in which case the hole 26 according to the drilling plan closest thereto can be indicated on the display unit 20 for instance with a bolder line thickness. If the operator 18 does not wish to position the drilling unit 5 at such a moment to the closest hole 26, but selects another hole as the hole 19 to be drilled next, then the operator 18 may move the symbol 5' towards the selected hole 19 and perform the manual displacement A. When the symbol 5' is transferred sufficiently close to the selected hole 19, i.e. to the intermediate position 5*b*, the hole 19 can be indicated on the display unit 20 with a bolder line thickness instead of the hole 26. Then the control unit 11 can be authorized to carry out the automatic positioning B to the starting point 14 of the selected hole 19. For the positioning, the control unit 11 may be provided with a distance limit 27, and the drilling unit 5 has to be placed at a shorter distance at the end of the manual displacement A.

Figure 6:
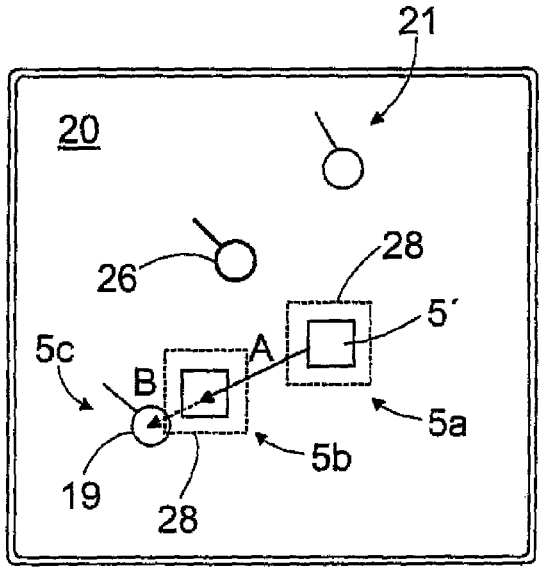

FIG. 6 illustrates how the positioning is carried out on the display unit 20. The symbol 5' of the drilling unit 5 may be provided with a distance limit 28, in which case the operator is able to see on the display unit 20, when the symbol 5' is transferred such that the distance limit 28 cuts the selected hole. After this the operator 18 may switch onto the automatic positioning B.

The manual displacement A of the drilling unit 5 can be performed in real time using the manual control devices 16 or it may be carried out using the control elements 25 of the display unit 20. When employing manual control elements 16 the location of the drilling unit, the drilling plan 21 and other required information for facilitating positioning can simultaneously be shown on the display unit 20. When control elements 25 of the user interface are used for manual displacement, the drilling unit 5 may simultaneously be transferred when the symbol thereof is moved on the display unit 20.

As shown in the above examples the invention allows using various ways to inform the control unit about the hole to be drilled next. The operator does not necessarily have to select the hole to be drilled next before starting the manual displacement, instead he may carry out a selection during the manual displacement and let the control unit suggest the hole to be drilled next during the manual displacement. There are various possibilities for selecting the moment when the manual displacement is changed to the automatic positioning.

It should be noted that the control unit 11 of the rock drilling rig 1 may include one or more telecommunication units allowing the control unit 11 to communicate in a wired or wireless fashion with the sensors 12, 13 and with the actuators included in the rock drilling rig 1 in order to convey measuring data and control commands. The control unit 11 may also include one or more reading devices for reading the software product and for providing control parameters. Alternatively information may be fed into the memory of the control unit 11 using the keyboard or the telecommunication connection. The control unit 11 may include one or more processors or a corresponding electronic devices, in which the software product can be carried out in order to perform the positioning of the invention. The software product can be read from a memory means or it may be loaded from another computer or data network. The software product can also be what is known as a hardware solution.

In some cases the features shown in this application can be used as such regardless of the other features. On the other hand the features shown in this application can be combined if need be to form different combinations.

The drawings and the specification associated therewith are merely intended to illustrate the idea of the invention. As regards the details, the invention may vary within the scope of the claims.

The invention claimed is:

1. A method for positioning a drilling unit of a rock drilling rig, the rock drilling rig comprising: at least one drilling boom; a drilling unit arranged in the drilling boom; at least one sensor for determining the location and direction of the drilling unit; at least one control unit provided with a drilling plan; and at least one control element for manually controlling the location of the drilling unit, and the method comprising:

determining the location of the drilling unit, positioning the drilling unit at a starting point of a drill hole determined in the drilling plan, aligning the drilling unit in a drilling direction determined in the drilling plan, drilling a drill hole according to the drilling plan, performing a manual displacement of the drilling unit towards one hole of the drilling plan in order to select by the manual displacement a next hole to be drilled, detecting in the control unit the selected next hole to be drilled, and performing sequentially after the hole selection and detection an automatic positioning, where the drilling unit is moved under the control of the control unit to the location of a starting point of the selected next drill hole in order to initiate drilling.

2. A method as claimed in claim 1, comprising identifying the hole to be drilled next in the control unit on the basis of the manual displacement.

3. A method as claimed in claim 1, comprising showing on a display unit of the control unit several starting points of the drill holes according to the drilling plan, showing the location of the drilling unit by means of a symbol on the display unit, and performing the manual displacement by moving the symbol of the drilling unit by means of the control elements of the display unit towards the next hole to be drilled.

4. A method as claimed in claim 1, comprising showing the location of the drilling unit by means of the symbol on the display unit, and indicating visually on the display unit the starting point of the drill hole, which is placed at the shortest distance from the drilling unit.

5. A method as claimed in claim 1, comprising providing the drilling plan while drilling with the starting point of at least one new hole to be drilled.

6. A method for positioning a drilling unit of a rock drilling rig, the rock drilling rig comprising: at least one drilling boom; a drilling unit arranged in the drilling boom; at least one sensor for determining the location and direction of the drilling unit; at least one control unit provided with a drilling plan; and at least one control element for manually controlling the location of the drilling unit, and the method comprising:

determining the location of the drilling unit, positioning the drilling unit at a starting point of a drill hole determined in the drilling plan, aligning the drilling unit in a drilling direction determined in the drilling plan, drilling a drill hole according to the drilling plan, performing a manual displacement of the drilling unit towards a next hole to be drilled, performing sequentially after the manual displacement an automatic positioning, where the drilling unit is moved under the control of the control unit to the location of a starting point of the next drill hole in order to initiate drilling, identifying in the control unit one hole of the drilling plan on the basis of the direction of the manual displacement, selecting the identified hole as a selected next hole to be drilled and activating after the manual displacement the automatic positioning to the location of a starting point of the selected next hole to be drilled.

7. A method for positioning a drilling unit of a rock drilling rig, the rock drilling rig comprising: at least one drilling boom; a drilling unit arranged in the drilling boom; at least one sensor for determining the location and direction of the drilling unit; at least one control unit provided with a drilling plan; and at least one control element for manually controlling the location of the drilling unit, and the method comprising:

determining the location of the drilling unit, positioning the drilling unit at a starting point of a drill hole determined in the drilling plan, aligning the drilling unit in a drilling direction determined in the drilling plan, drilling a drill hole according to the drilling plan, performing a manual displacement of the drilling unit towards a next hole to be drilled, performing sequentially after the manual displacement an automatic positioning, where the drilling unit is moved under the control of the control unit to the location of a starting point of the next drill hole in order to initiate drilling, determining in the control unit the distance of the drilling unit to at least some of the starting points of the holes to be drilled according to the drilling plan, making a suggestion from the control unit to an operator for transferring from the manual displacement to the automatic positioning and for carrying out the positioning into the closest hole, and performing the automatic positioning at the starting point of the closest drill hole after the acceptance of the operator.

8. A method for positioning a drilling unit of a rock drilling rig, the rock drilling rig comprising: at least one drilling boom; a drilling unit arranged in the drilling boom; at least one sensor for determining the location and direction of the drilling unit; at least one control unit provided with a drilling plan; and at least one control element for manually controlling the location of the drilling unit, and the method comprising:

determining the location of the drilling unit, positioning the drilling unit at a starting point of a drill hole determined in the drilling plan, aligning the drilling unit in a drilling direction determined in the drilling plan, drilling a drill hole according to the drilling plan, performing a manual displacement of the drilling unit towards a next hole to be drilled, performing sequentially after the manual displacement an automatic positioning, where the drilling unit is moved under the control of the control unit to the location of a starting point of the next drill hole in order to initiate drilling, identifying the hole to be drilled next in the control unit on the basis of the manual displacement, determining in the control unit the distance of the drilling unit to at least some of the starting points of the holes according to the drilling plan, identifying in the control unit as the hole to be drilled next the hole according to the drilling plan that is closest to the drilling unit after the manual displacement, activating the automatic positioning, and performing the automatic positioning at the starting point of the closest drill hole.

9. A method for positioning a drilling unit of a rock drilling rig, the rock drilling rig comprising: at least one drilling boom; a drilling unit arranged in the drilling boom; at least one sensor for determining the location and direction of the drilling unit; at least one control unit provided with a drilling plan; and at least one control element for manually controlling the location of the drilling unit, and the method comprising:

determining the location of the drilling unit, positioning the drilling unit at a starting point of a drill hole determined in the drilling plan, aligning the drilling unit in a drilling direction determined in the drilling plan, drilling a drill hole according to the drilling plan, performing a manual displacement of the drilling unit towards a next hole to be drilled, performing sequentially after the manual displacement an automatic positioning, where the drilling unit is moved under the control of the control unit to the location of a starting point of the next drill hole in order to initiate drilling, determining for the control unit at least one distance limit, which defines the longest allowed distance between the drilling unit and the starting point of the selected hole, and allowing not to start the automatic positioning until the distance from the drilling unit to the starting point of the hole selected by the operator is shorter than the defined distance limit.

10. A software product for controlling a drilling unit in a rock drilling rig, the rock drilling rig comprising: at least one drilling boom, a drilling unit arranged in the drilling boom, at least one sensor for measuring the location and direction of the drilling unit, at least one control unit, and at least one control element for the manual displacement of the drilling unit, and performing the software product in the control unit is arranged to achieve determining the location of the drilling unit in the control unit on the basis of the measuring results obtained from the sensors, positioning the drilling unit to the starting point of the drill hole determined in the drilling plan, drilling the drill hole in the drilling direction according to the drilling plan, determine the location of the drilling unit in the control unit in relation to at least some of the starting points of the holes according to the drilling plan, allow the manual displacement of the drilling unit performed by the operator towards the drill hole to be drilled next, and perform subsequently after the manual displacement the automatic positioning to the starting point of the hole to be drilled next in order to initiate drilling, wherein performing the software product is arranged to achieve the automatic positioning at the drill hole, whose distance from the drilling unit is the shortest at the end of the manual displacement.

11. A software product as claimed in claim 10, wherein performing the software product is arranged to achieve showing the drilling plan included in the control unit on the display unit of the control unit, in which case at least the starting points of the holes to be drilled are visible on the display unit, showing the location of the drilling unit on the display unit of the control unit by means of the symbol and in relation to the starting points of the holes to be drilled, and performing the manual displacement by moving the symbol with the control element included in the display unit.

12. A software product as claimed in claim 10, wherein performing the software product is arranged to achieve that the control unit identifies the hole to be drilled next on the basis of the direction of the manual displacement and is ready after the identification to perform the automatic positioning to the starting point of the hole concerned.

13. A software product as claimed in claim 10, wherein performing the software product is arranged to achieve that the control unit determines distances to the starting points of all holes according to the drilling plan substantially continuously.

14. A software product for controlling a drilling unit in a rock drilling rig, the rock drilling rig comprising: at least one drilling boom, a drilling unit arranged in the drilling boom, at least one sensor for measuring the location and direction of the drilling unit, at least one control unit, and at least one control element for the manual displacement of the drilling unit, and performing the software product in the control unit is arranged to achieve determining the location of the drilling unit in the control unit on the basis of the measuring results obtained from the sensors, positioning the drilling unit to the starting point of the drill hole determined in the drilling plan, drilling the drill hole in the drilling direction according to the drilling plan, determine the location of the drilling unit in the control unit in relation to at least some of the starting points of the holes according to the drilling plan, allow the manual displacement of the drilling unit performed by the operator towards the drill hole to be drilled next, and perform subsequently after the manual displacement the automatic positioning to the starting point of the hole to be drilled next in order to initiate drilling, wherein performing the software product in the control unit is further arranged to monitor the manual displacement and to identify the drill hole to be drilled next on the basis of the manual displacement, and perform after the manual displacement the automatic positioning to the starting point of the identified hole to be drilled next in order to initiate drilling.

15. A software product for controlling a drilling unit in a rock drilling rig, the rock drilling rig comprising: at least one drilling boom, a drilling unit arranged in the drilling boom, at least one sensor for measuring the location and direction of the drilling unit, at least one control unit, and at least one control element for the manual displacement of the drilling unit, and performing the software product in the control unit is arranged to achieve determining the location of the drilling unit in the control unit on the basis of the measuring results obtained from the sensors, positioning the drilling unit to the starting point of the drill hole determined in the drilling plan, drilling the drill hole in the drilling direction according to the drilling plan, determine the location of the drilling unit in the control unit in relation to at least some of the starting points of the holes according to the drilling plan, allow the manual displacement of the drilling unit performed by the operator towards the drill hole to be drilled next, and perform subsequently after the manual displacement the automatic positioning to the starting point of the hole to be drilled next in order to initiate drilling, wherein performing the software product is arranged to prevent the transfer of the control unit from the manual displacement to the automatic positioning if the drilling unit is placed at a longer distance than the predetermined distance limit from the starting point of the hole to be drilled next.

16. A rock drilling rig comprising:

a movable carrier, at least one drilling boom and at least one drilling unit comprising a feeding beam arranged in the drilling boom, a rock drilling machine that is movable by means of a feeding device in respect of the feeding beam, and a tool is connectable to the rock drilling machine, at least one control unit provided with a drilling plan, in which at least the starting points of the holes to be drilled are defined, and the control unit allowing the automatic control of the drilling unit, at least one control element for manually controlling the drilling unit, at least one sensor for determining the position and direction of the drilling unit, means for positioning the drilling unit at the hole to be drilled, and wherein the control unit is arranged to determine the location of the drilling unit in relation to at least some of the starting points of the holes according to the drilling plan, the drilling unit is arranged to be displaced at first manually towards the next drill hole to be drilled, and the control unit is arranged to perform subsequently after the manual displacement the automatic positioning to the starting point of the next hole in order to initiate drilling.

* * * * *